US010247143B2

(12) United States Patent
Watanabe

(10) Patent No.: US 10,247,143 B2
(45) Date of Patent: Apr. 2, 2019

(54) EXHAUST GAS RECIRCULATION APPARATUS

(71) Applicant: FUJI JUKOGYO KABUSHIKI KAISHA, Tokyo (JP)

(72) Inventor: Hiroshi Watanabe, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 15/433,268

(22) Filed: Feb. 15, 2017

(65) Prior Publication Data

US 2017/0260933 A1 Sep. 14, 2017

(30) Foreign Application Priority Data

Mar. 10, 2016 (JP) ..... 2016-046583
Mar. 10, 2016 (JP) ..... 2016-046584
Mar. 10, 2016 (JP) ..... 2016-046585

(51) Int. Cl.
*F02M 26/00* (2016.01)
*F02M 26/17* (2016.01)
(Continued)

(52) U.S. Cl.
CPC ..... *F02M 26/17* (2016.02); *F02D 9/02* (2013.01); *F02M 26/65* (2016.02); *F02M 35/10222* (2013.01)

(58) Field of Classification Search
CPC ..... F02D 9/104; F02D 9/1055; F02D 9/02; F02M 26/17; F02M 26/65; F02M 35/10222
See application file for complete search history.

(56) References Cited

U.S. PATENT DOCUMENTS 5,924,398 A * 7/1999 Choi ..... F02D 9/104 123/184.21
6,138,651 A * 10/2000 Mori ..... F02M 26/19 123/568.17
(Continued)

FOREIGN PATENT DOCUMENTS

JP S57-186647 11/1982
JP 03-114563 U1 5/1991
(Continued)

OTHER PUBLICATIONS

Japanese Office Action dated Jul. 11, 2017, in Japanese Patent Application No. 2016-046584 (5 pages—Japanese with English translation).

*Primary Examiner* — Hieu T Vo
*Assistant Examiner* — Sherman Manley
(74) *Attorney, Agent, or Firm* — Smith, Gambrell & Russell, LLP

(57) ABSTRACT

A exhaust gas recirculation apparatus includes a throttle body; an intake manifold configured to distribute intake air to each intake port in an engine; an adapter member including a through channel capable of guiding the intake air to the intake manifold from the throttle body; and a gas supply path capable of guiding part of exhaust gas to an intake system from an exhaust system. The adapter member includes an inlet port, a discharge port, and a coupling channel. A first opening is wider than a second opening when the discharge port is divided into the first opening and the second opening at an imaginary plane, serving as a boundary, which includes a center line of a valve shaft and which extends along an extending-through direction of the through channel.

12 Claims, 12 Drawing Sheets

(51) Int. Cl.

| | |
|---|---|
| ***F02M 26/65*** | (2016.01) |
| ***F02D 9/02*** | (2006.01) |
| ***F02M 35/10*** | (2006.01) |

(56) References Cited

U.S. PATENT DOCUMENTS 7,552,722 B1 * 6/2009 Shieh ..... F02M 26/19 123/568.17
7,556,031 B2 * 7/2009 Russell ..... B01F 5/061 123/306
7,798,135 B2 * 9/2010 Bischofberger ..... F02M 35/10118 123/568.11
8,033,714 B2 * 10/2011 Nishioka ..... B01D 53/8631 137/888
8,181,633 B2 * 5/2012 Ito ..... F02B 31/06 123/568.17
8,746,216 B2 * 6/2014 Elsasser ..... B01F 3/02 123/568.11
9,051,900 B2 * 6/2015 Teng ..... F02B 31/04
9,739,240 B2 * 8/2017 DiDonato, Jr. ..... F02M 26/06
2003/0111065 A1 * 6/2003 Blum ..... F02D 9/104 123/568.17
2003/0115871 A1 * 6/2003 Feucht ..... F02D 9/104 60/605.1
2010/0065028 A1 * 3/2010 Styles ..... F02D 9/1035 123/568.17
2013/0255616 A1 * 10/2013 Yao ..... F02M 35/104 123/184.21
2015/0322867 A1 * 11/2015 Ito ..... F02M 35/10262 123/184.21
2016/0177880 A1 * 6/2016 Hartzler ..... F02M 35/10222 123/568.12

FOREIGN PATENT DOCUMENTS

JP 2001-304044 10/2001
WO 2014/098010 A1 6/2014

* cited by examiner

EXHAUST GAS RECIRCULATION APPARATUS

CROSS-REFERENCES TO RELATED APPLICATIONS

The present application claims priority from Japanese Patent Application No. 2016-046583 filed on Mar. 10, 2016, Japanese Patent Application No. 2016-046584 filed on Mar. 10, 2016, and Japanese Patent. Application No. 2016-046585 filed on Mar. 10, 2016, the entire contents of which are hereby incorporated by reference.

BACKGROUND

1. Technical Field

The present invention relates to a exhaust gas recirculation apparatus that supplies exhaust gas to an intake system.

2. Related Art

A exhaust gas recirculation apparatus that supplies part of exhaust gas to an intake system of an engine by coupling an exhaust system and the intake system of the engine to each other is proposed (see Japanese Unexamined. Utility Model (Registration) Application Publication No. 3-114563). By mixing the exhaust gas with intake air flowing towards a combustion chamber in this way, combustion temperature can be reduced, to increase exhaust gas cleaning performance, and pumping loss can be reduced to increase fuel efficiency.

In order to further increase fuel efficiency and exhaust gas cleaning performance of an engine, it is necessary to equally distribute exhaust gas to each intake port in the engine. That is, the exhaust gas recirculation apparatus is required to properly mix intake air and the exhaust gas.

SUMMARY OF THE INVENTION

It is desirable to properly mix intake air and exhaust gas.

An aspect of the present invention provides a exhaust gas recirculation apparatus including a throttle body that is configured to be disposed in an intake system of an engine, and that comprises a throttle valve and a valve shaft that supports the throttle valve, the throttle valve comprising a first end and a second end; an intake manifold that is configured to be disposed in the intake system of the engine, and distribute intake air to each intake port in the engine; an adapter member that is configured to be disposed between the throttle body and the intake manifold, and that, comprises a through channel capable of guiding the intake air to the intake manifold from the throttle body; and a gas supply path that is configured to be coupled to the intake system and an exhaust system of the engine, and guide part of exhaust gas to the intake system from the exhaust system. The adapter member includes an inlet port to which the gas supply path is coupled, a discharge port that opens into the through channel, and a coupling channel that couples the inlet port and the discharge port. The first end of the throttle valve is movable away from the adapter member when opening the throttle valve, and the second end is movable towards the adapter member when opening the throttle valve. A first opening is wider than a second opening when the discharge port is divided into the first opening and the second opening at an imaginary plane, serving as a boundary, the first opening being disposed towards the first end, the second opening being disposed towards the second end, the imaginary plane including a center line of the valve shaft and extending along an extending-through direction of the though channel.

An opening area of the discharge port may be larger than an opening area of the inlet port.

The adapter member may further include a pair of the discharge ports opposing each other.

The imaginary plane may be a plane that includes the center line of the valve shaft and that coincides with or is parallel to a center line of the through channel.

The adapter member may further include an expanded chamber that is disposed in the coupling channel and into which the discharge port opens.

The adapter member may further include a restrictor that is disposed in the coupling channel and upstream from the expanded chamber, and that has a channel sectional area, that is smaller than those of other portions of the coupling channel.

DETAILED DESCRIPTION

Figure 1:
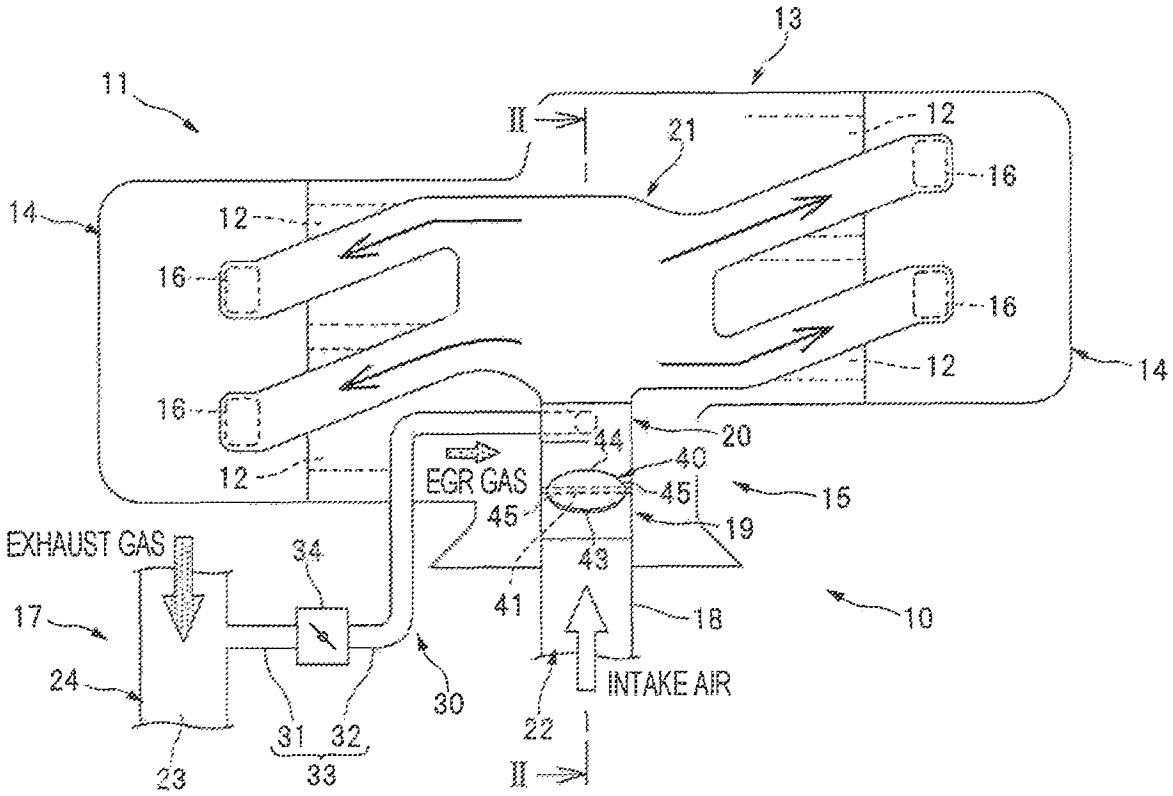
FIG. 1 is a schematic view of an engine including a exhaust gas recirculation apparatus according to an example of the present invention.

Examples according to the present invention are hereunder described in detail on the basis of the drawings. FIG. 1 is a schematic view of an engine 11 including a exhaust gas recirculation apparatus 10 according to an example of the present invention. Although the illustrated engine 11 is a horizontally opposed engine, the engine 11 is not limited thereto. The engine 11 may be, for example, an in-line engine or a V engine.

As illustrated in FIG. 1, the engine 11 includes a cylinder block 13 and a cylinder head 14 that is mounted on the cylinder block 13. The cylinder block 13 has a plurality of cylinder bores 12. The cylinder head 14 has a plurality of intake ports 16 that are coupled to an intake system 15, and a plurality of exhaust ports (not illustrated) that are coupled to an exhaust system 17. The intake system 15 has an intake passage 22 defined by an intake duct 18, a throttle body 19, an EGR adapter (adapter member) 20, an intake manifold 21, etc. The exhaust system 17 has an exhaust passage 24 defined by an exhaust pipe 23, an exhaust manifold (not illustrated), etc. Intake air that flows through the intake passage 22 flows through the throttle body 19 to have its flow rate adjusted. Then, the intake air is distributed to each intake port 16 via the intake manifold 21, and is supplied to a combustion chamber (not illustrated) from the intake ports 16. Exhaust gas that is exhausted from the combustion chamber is supplied to the exhaust passage 24 from the exhaust ports (not illustrated), and is exhausted to the outside via a catalytic converter and a muffler (not illustrated).

In order to increase, for example, fuel efficiency and exhaust gas cleaning performance of the engine 11, the engine 11 includes an exhaust gas recirculation system 30 that causes part of the exhaust gas to recirculate in the intake system 15. The exhaust gas recirculation system 30 includes an EGR supply path (gas supply path) 33 defined by supply pipes 31 and 32. The supply pipe 31 that defines an upstream side of the EGR supply path 33 is coupled to the exhaust pipe 23 of the exhaust system 17. The supply pipe 32 that defines a downstream side of the EGR supply path 33 is coupled to the EGR adapter 20 at the intake system 15. An EGR valve 34 that controls the flow rate of EGR gas is disposed between the supply pipe 31 and the supply pipe 32. By forming the exhaust gas recirculation system 30 in this way, part of the exhaust gas is supplied as EGR gas to the intake system 15, and the supply amount of EGR gas is controlled by the EGR valve 34. EGR stands for "Exhaust Gas Recirculation".

Figure 2:
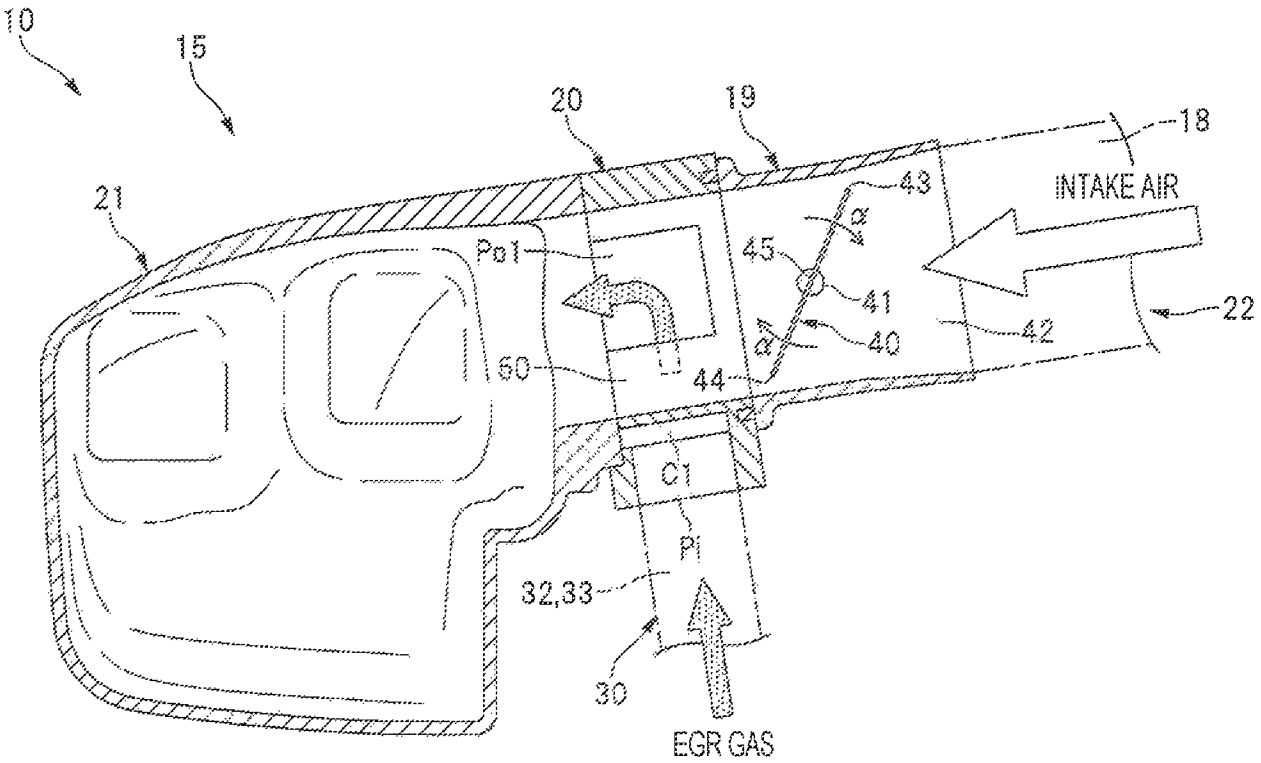
FIG. 2 is a sectional view of an intake system taken along line II-II in FIG. 1.

FIG. 2 is a sectional view of the intake system 15 taken along line II-II in FIG. 1. As illustrated in FIGS. 1 and 2, the throttle body 19 of the intake system 15 includes a disc-shaped throttle valve 40 and a valve shaft 41 that supports the throttle valve 40. By driving the valve shaft 41 by a throttle motor (not illustrated), it is possible to rotate the throttle valve 40 in an opening direction and a closing direction and to open and close an intake channel 42 in the throttle body 19. The illustrated throttle body 19 is a so-called butterfly throttle body, and has a structure in which the throttle valve 40 rotates around the valve shaft 41 at the center of the throttle valve 40. Therefore, as illustrated by arrows a in FIG. 2, when opening the throttle valve 40, an upper end (first end) 43 of the throttle valve 40 moves away from the EGR adapter 20, and a lower end (second end) 44 of the throttle valve 40 moves towards the EGR adapter 20.

Figure 3:
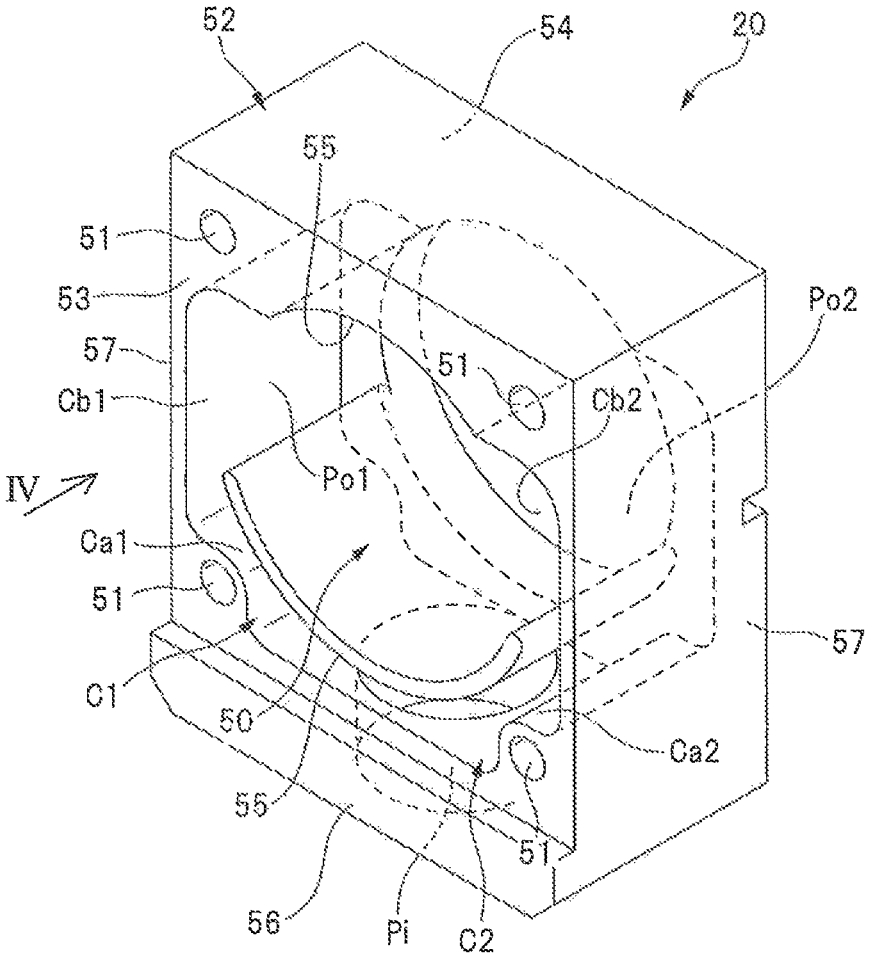
FIG. 3 is a perspective view of an EGR adapter.

FIG. 3 is a perspective view of the EGR adapter 20. As illustrated in FIGS. 1 to 3, the EGR, adapter 20 that is disposed at a downstream side of the throttle body 19 has an intake channel (through channel) 50 that guides intake air from the throttle body 19 to the intake manifold 21. The EGR adapter 20 has an inlet port Pi to which the EGR supply path 33 is coupled, discharge ports Po1 and Po2 that open into the intake channel 50, and coupling channels C1 and C2 that allow the inlet port Pi and the discharge ports Po1 and Po2 to communicate with each other. By forming the EGR adapter 20 in this way, EGR gas supplied to the inlet port Pi from the EGR supply path 33 is discharged to the intake channel 50 via the coupling channels C1 and C2 and the discharge ports Po1 and Po2. The EGR gas discharged to the intake channel 50 from the discharge ports Po1 and Po2 is distributed, along with the intake air, to each intake port 16 via the intake manifold 21. In FIG. 2, which is a sectional view, one of the discharge ports Po1 and Po2, that is, the discharge port Po1 is illustrated, and one of the coupling channels C1 and C2, that is, the coupling channel C1 is illustrated.

Structure of EGR Adapter

Figure 4C:
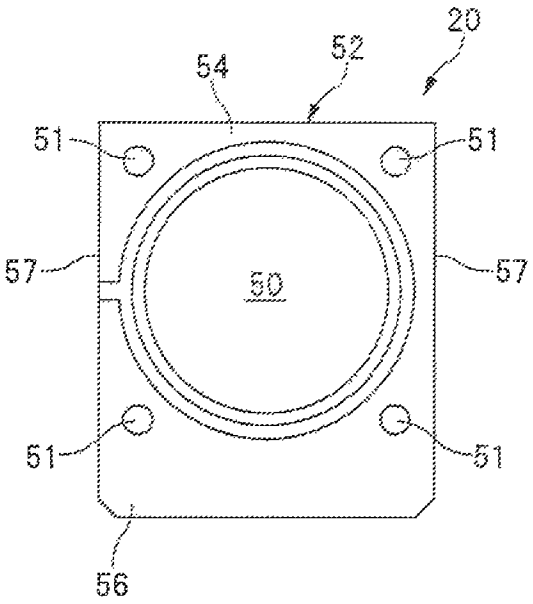
FIG. 4C is a back view of the EGR adapter.
Figure 4B:
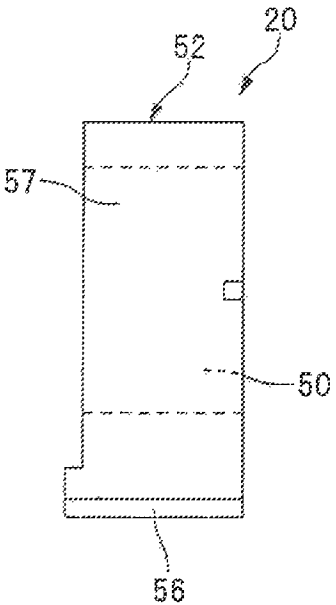
FIG. 4B is a side view of the EGR adapter.
Figure 4A:
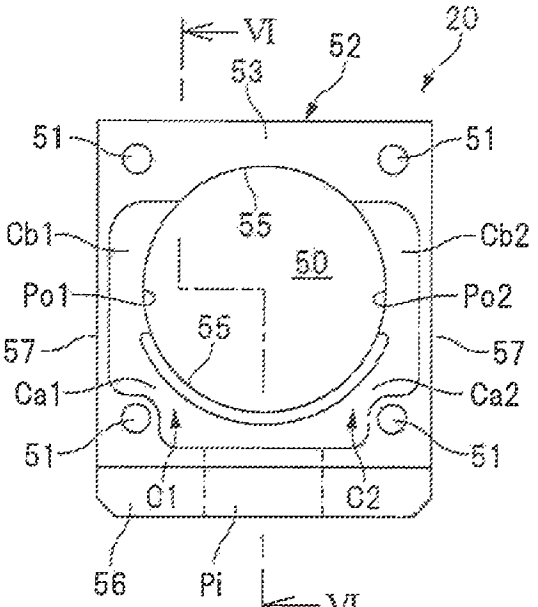
FIG. 4A is a front view of the EGR adapter that is seen, from the direction of arrow IV in FIG. 3.
Figure 4D:
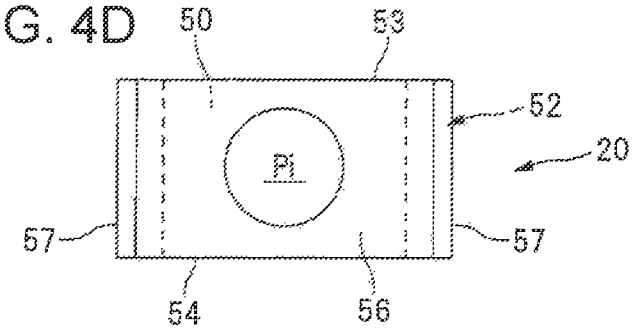
FIG. 4D is a bottom view of the EGR adapter.

Next, a structure of the EGR adapter 20 that discharges EGR gas to the intake system 15 is described. FIG. 4A is a front view of the PGR adapter 20 that is seen from the direction of arrow IV in FIG. 3. FIG. 4B is a side view of the EGR adapter 20. FIG. 4C is a hack view of the EGR adapter 20. FIG. 4D is a bottom view of the EGR adapter 20.

As illustrated in FIGS. 3 to 4D, the EGR adapter 20 includes a substantially rectangular parallelepiped adapter body 52 having bolt holes 51 in the four corners. One end of the adapter body 52 in a thickness direction has a mounting surface 53 that is mounted on the intake manifold 21, and the other end of the adapter body 52 in the thickness direction has a mounting surface 54 that is mounted on the throttle body 19. The adapter body 52 has the intake channel 50 extending therethrough from the one end to the other end in the thickness direction. Further, a channel wall 55 that serves as a boundary at the intake channel 50 in the adapter body 52 has the discharge port Po1 and the discharge port Po2 that oppose each other. That is, the channel wall 55 that serves as a boundary at the intake channel 50 by surrounding the intake channel 50 has the pair of discharge ports Po1 and Po2 that open into the intake channel 50. The discharge ports Po1 and Po2 are formed at portions crossing an imaginary plane X.

A lower portion 56 of the adapter body 52 has the inlet port Pi to which the supply pipe 32 defining the EGR supply path 33 is coupled. From the lower portion 56 to sides 57 of the adapter body 52, the first coupling channel C1 that couples the inlet port Pi and the discharge port Po1 and the second coupling channel C2 that couples the inlet port Pi and the discharge port Po2 are formed. As illustrated in FIG. 4A, the first coupling channel C1 includes a first restrictor Ca1 having a channel sectional area that is smaller than, those of other portions of the coupling channel C1. The first coupling channel C1 also includes a first expanded chamber Cb1 at a downstream side of the first restrictor Ca1. The discharge port Po1 opens into the first expanded chamber Cb1. The first expanded chamber Cb1 is adjacent to the intake channel 50. Similarly, the second coupling channel C2 includes a second restrictor Ca2 having a channel sectional area that is smaller than those of other portions of the coupling channel C2. The second coupling channel C2 also includes a second expanded chamber Cb2 at a downstream side of the second restrictor Ca2. The discharge port Po2 opens into the second expanded clamber Cb2. The second expanded chamber Cb2 is adjacent to the intake channel 50.

Basic Structures of Discharge Ports

Figure 5A:
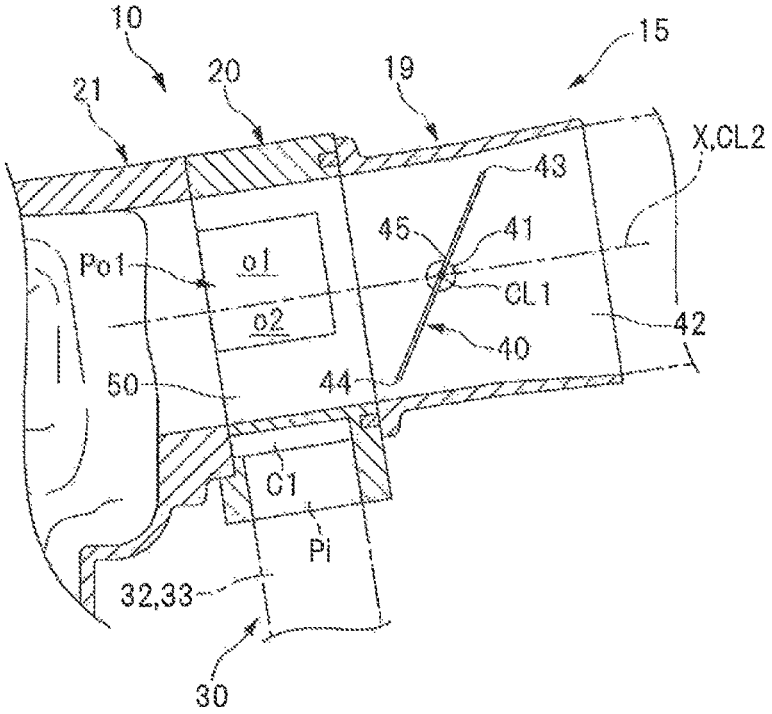
FIG. 5A is a sectional view illustrating a relationship between the position of a throttle body and the position of the EGR adapter.
Figure 5B:
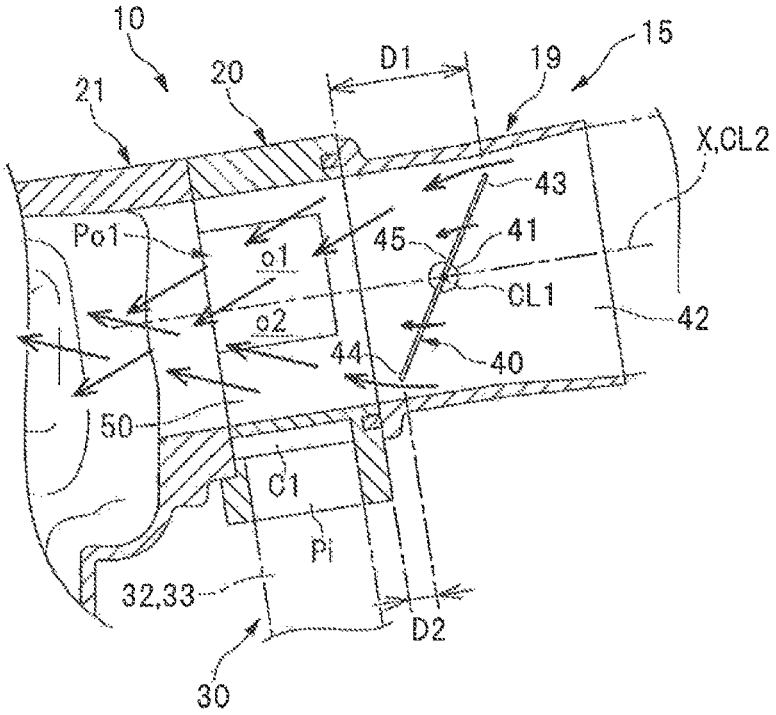
FIG. 5B is an explanatory view illustrating a state of flow of intake air by using arrows.
Figure 6:
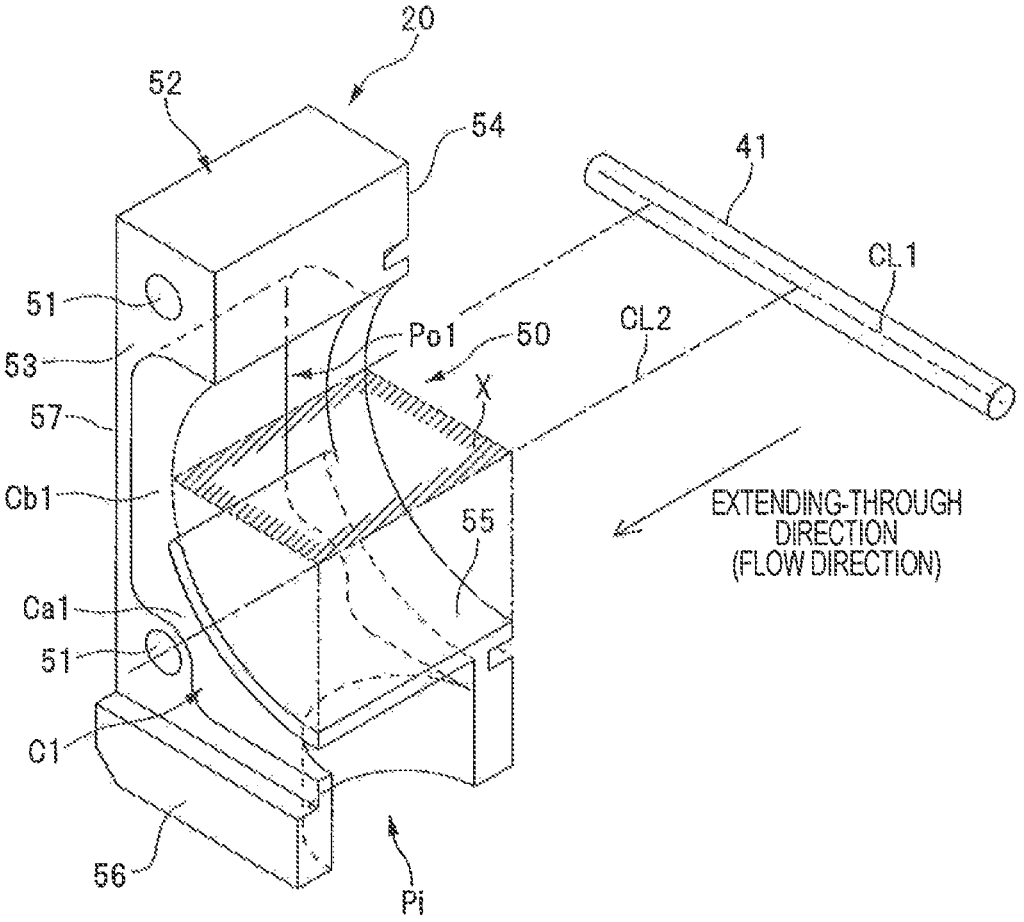
FIG. 6 is a perspective view of the EGR adapter divided along line VI-VI in FIG. 4A.

Next, basic structures of the discharge ports Po1 and Po2 that discharge EGR gas are described. FIG. 5A is a sectional view illustrating a relationship between the position of the throttle body 19 and the position of the EGR adapter 20. FIG. 5B is an explanatory view illustrating a state of flow of intake air by using arrows. FIGS. 5A and 5B illustrate members corresponding to those illustrated in FIG. 2. FIG. 6 is a perspective view of the EGR adapter 20 divided along line VI-VI in FIG. 4A. FIG. 6 illustrates a relationship between the position of the EGR adapter 20 and the imaginary plane X. In the specification, the structure of one of the discharge ports, that is, the discharge port. Po1 is primarily described. Since the other discharge port Po2 has the same structure as the discharge port Po1, the structure of the other discharge port Po2 is not described.

As illustrated in FIG. 5A, the discharge port Po1 in the corresponding side portion 57 of the adapter body 52 is formed at a portion crossing the imaginary plane X. Here, as illustrated in FIGS. 5A and 6, the imaginary plane X is a plane that includes a center line CL1 of the valve shaft 41 and that extends along an extending-through direction of the intake channel 50. In other words, the imaginary plane X is a plane that includes the center line CL1 of the valve shaft 41, and that coincides with or is parallel to a center line CL2 of the intake channel 50. That is, the imaginary plane X is a plane that includes the center line CL1 of the valve shaft 41, and that extends along a direction of flow of intake air. By forming the discharge port Po1 at a portion crossing the imaginary plane X in this way, as described below, it is possible to properly mix intake air and EGR gas.

As mentioned above, the valve shaft 41 extending in a width direction is fixed to the center of the throttle valve 40, and the throttle valve 40 rotates around the valve shaft 41 when opening and closing the intake channel 42. Therefore, when opening the throttle valve 40, the intake channel 42 opens by a large amount near the upper end 43 and the lower end 44, whereas the intake channel 42 is opened by a small amount near side ends 45 of the throttle valve 40. That is, when opening the throttle valve 40, the flow rates of intake air are increased by a large amount near the upper end 43 and the lower end 44 of the throttle valve 40, whereas the flow rate of intake air is increased by a small amount near the side ends 45 of the throttle valve 40.

Accordingly, since it is difficult for the intake air to flow near the side ends 45 of the throttle valve 40 than near the upper end 43 and the lower end 44 of the throttle valve 40, the flow rate of the intake air near the side ends 45 of the throttle valve 40 tends to be reduced compared to those near the upper end 43 and the lower end 44 of the throttle valve 40. Therefore, as illustrated by the arrows in FIG. 5B, it is assumed that the intake air that has passed near the upper end 43 of the throttle valve 40 is drawn in in a downward direction so as to be twisted, whereas it is assumed that the intake air that has passed near the lower end 44 of the throttle valve 40 is drawn in in an upward direction so as to be twisted. Accordingly, a space extending downstream from the side ends 45 of the throttle valve 40, that is, a space in the imaginary plane X and near the imaginary plane X is a space in which turbulence tends to occur because of the crossing of portions of the intake air.

Therefore, the EGR adapter 20 has the discharge port Po1, which discharges EGR gas, at a portion crossing the imaginary plane X. This makes it possible to supply EGR gas with respect to turbulent intake air, so that it is possible to actively mix the intake air and the EGR gas by making use of the turbulent flow of the intake air. Therefore, it is possible to reduce variations in the proportion of EGR gas contained in the intake air (hereunder referred to as the "EGR percentage content"), and to substantially equally supply the EGR gas to each intake port 16.

Opening Position of Discharge Port

Next, the opening position of the discharge port Po1 that discharges EGR gas is described in more detail. As illustrated in FIG. 5A, the discharge port Po1 is formed towards the upper end 43 of the throttle valve 40, that is, towards the upper side of the throttle valve 40. In other words, when the discharge port Po1 is divided into a first opening o1 and a second opening o2 at the imaginary plane X serving as a boundary, the first opening o1 located above the second opening o2 is wider than the second opening o2 located below the first opening o1. By making the opening area of the first opening o1 larger than the opening area of the second opening o2, that is, by forming the discharge port Po1 towards the upper side, it is possible to properly mix intake air and EGR gas as described below.

As illustrated in FIG. 5B, a distance D1 from the upper end 43 of the throttle valve 40 to the EGR adapter 20 is less than a distance D2 from the lower end 44 of the throttle valve 40 to the EGR adapter 20. Therefore, intake air passing near the upper end 43 of the throttle valve 40 and flowing downward reaches the center line CL2 of the intake channel 50 and the imaginary plane X at a location towards the throttle body 10 at an upstream side than intake air passing near the lower end. 44 of the throttle valve 40 and flowing upward. That is, it is assumed that the intake air tends to gather at an upper portion than at a lower portion of the intake channel 50 in the EGR adapter 20. Therefore, in the EGR adapter 20, by disposing the discharge port Po1 towards the upper side of the throttle valve 40, a large amount of EGR gas is discharged to the upper portion of the intake channel 50 at which the intake air tends to gather. This makes it possible to reduce variations in EGR percentage content in the intake air, and to substantially equally supply the EGR gas to each intake port 16.

Figure 7A:
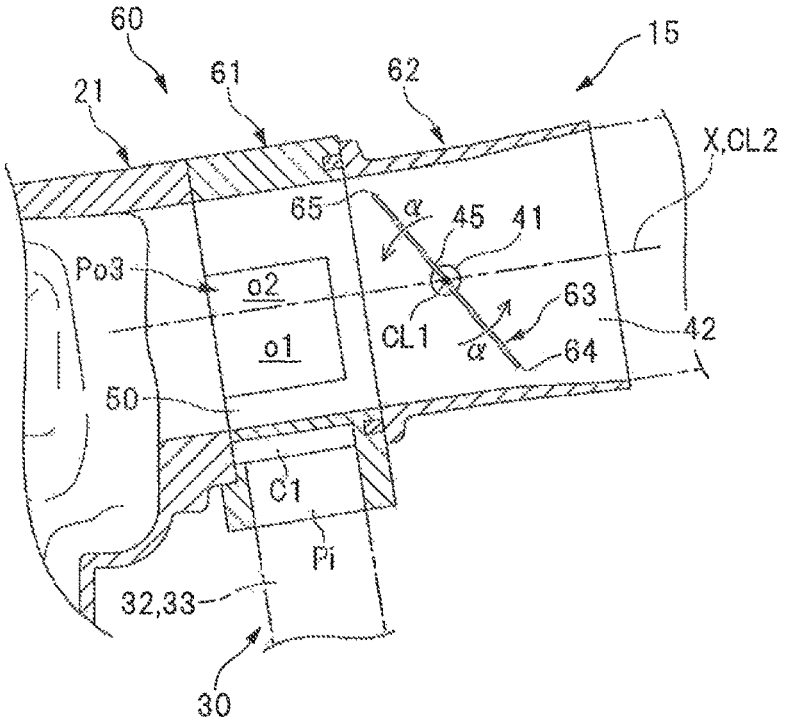
FIGS. 7A and 7B are each a sectional view illustrating part of an intake system of a exhaust gas recirculation apparatus according to another example of the present invention.
Figure 7B:
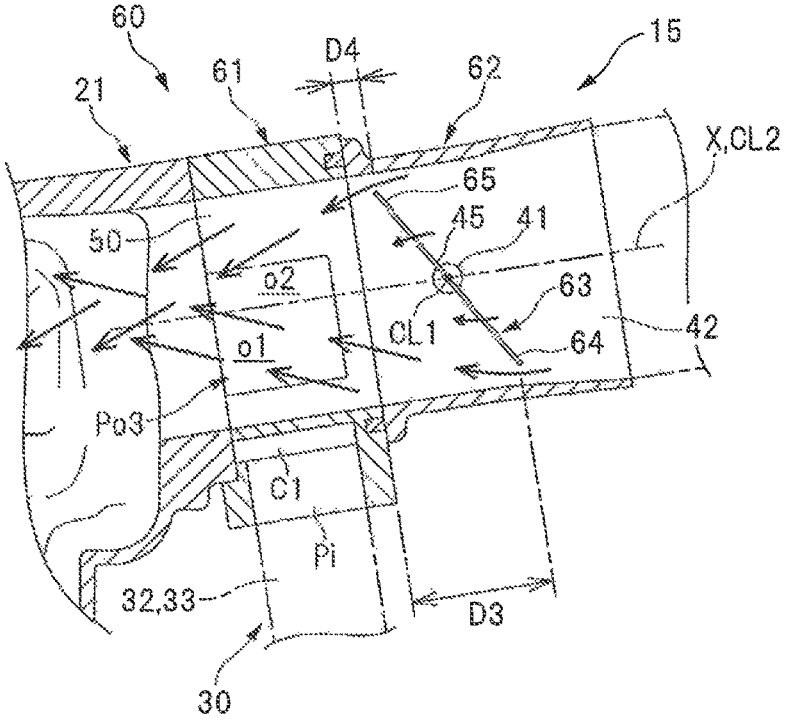

Although, in the foregoing description, the discharge port Po1 in the EGR adapter 20 is formed towards the upper side of the throttle valve 40, the discharge port Po1 is not limited thereto. The discharge port Po1 in the EGR adapter may be formed towards the lower side of the throttle valve 40, FIGS. 7A and 7B are each a sectional view illustrating part of an intake system 15 of a exhaust gas recirculation apparatus 60 according to another example of the present invention. FIG. 7A illustrates a relationship between the position of an EGR adapter 61 and the position of a throttle body 62. FIG. 7B illustrates a state of flow of intake air by using arrows. In FIGS. 7A and 7B, portions and members corresponding to those in FIGS. 5A and 5B are given the same reference numerals, and are not described. FIGS. 7A and 7B illustrate one of the discharge ports, that is, a discharge port Po3.

As illustrated in FIG. 7A, the intake system 15 of the engine 11 includes an intake manifold 21, an EGR adapter 61, and a throttle body 62. As illustrated by arrows a in FIG. 7A, when opening a throttle valve 63 at the throttle body 19, a lower end (first end) 64 of the throttle valve 63 moves away from the EGR adapter 61, and an upper end (second end) 65 of the throttle valve 63 moves towards the EGR adapter 61. As illustrated in FIG. 7A, the discharge port Po3 in the EGR adapter 61 is formed towards the lower end 64 of the throttle valve 63, that is, towards a lower side of the throttle valve 63. That is, when the discharge port Po3 is divided into a first opening o1 and a second opening o2 at an imaginary plane X serving as a boundary, the first opening o1 located below the second opening o2 is wider than the second opening o2 located above the first opening o1. In this way, by disposing the discharge port Po3 towards the lower side of the throttle valve 63, it is possible to properly mix intake air and EGR gas as in the EGR adapter 61 described above.

That is, as illustrated in FIG. 7B, a distance D3 from the lower end 64 of the throttle valve 63 to the EGR adapter 61 is greater than a distance D4 from the upper end 65 to the EGR adapter 61. Therefore, intake air passing near the lower end 64 of the throttle valve 63 and flowing upward reaches the center line CL2 of an intake channel 50 and the imaginary plane X at a location towards the throttle body 62 at an upstream side than intake air passing near the upper end 65 of the throttle valve 63 and flowing downward. In this way, it is assumed that the intake air tends to gather at a lower portion than at an upper portion of the intake channel 50 of the EGA adapter 61. Therefore, in the EGR adapter 61, the discharge port Po3 that discharges EGR gas is disposed towards the lower side of the EGR adapter 61. Consequently, it is possible to discharge a large amount of EGR gas to the lower portion of the intake channel 50 at which intake air tends to gather, and to reduce variations in the EGR percentage content in the intake air.

Opening Areas of Discharge Ports

Figure 8:
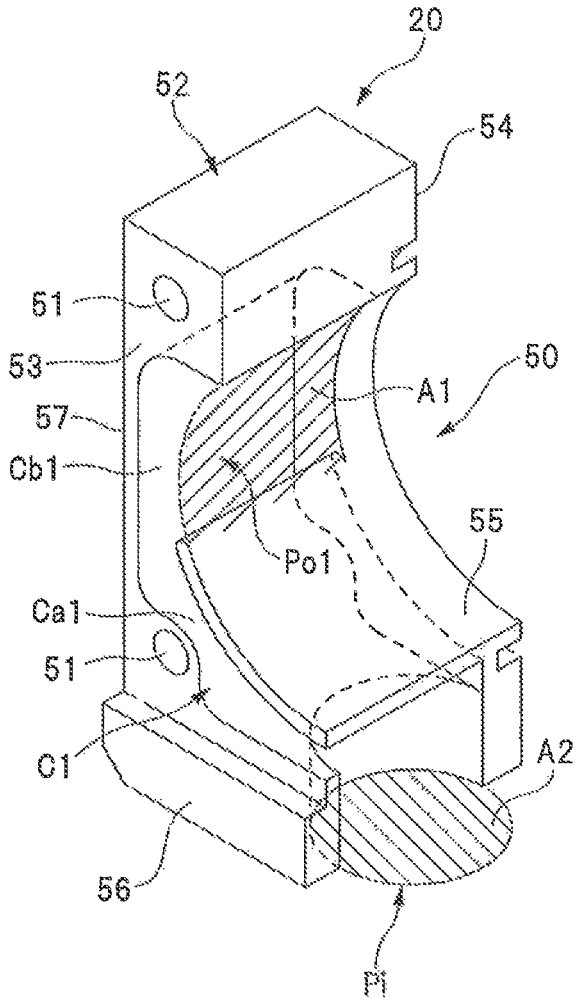
FIG. 8 is an explanatory view illustrating an opening area of an inlet port and an opening area of a discharge port.
Figure 9:
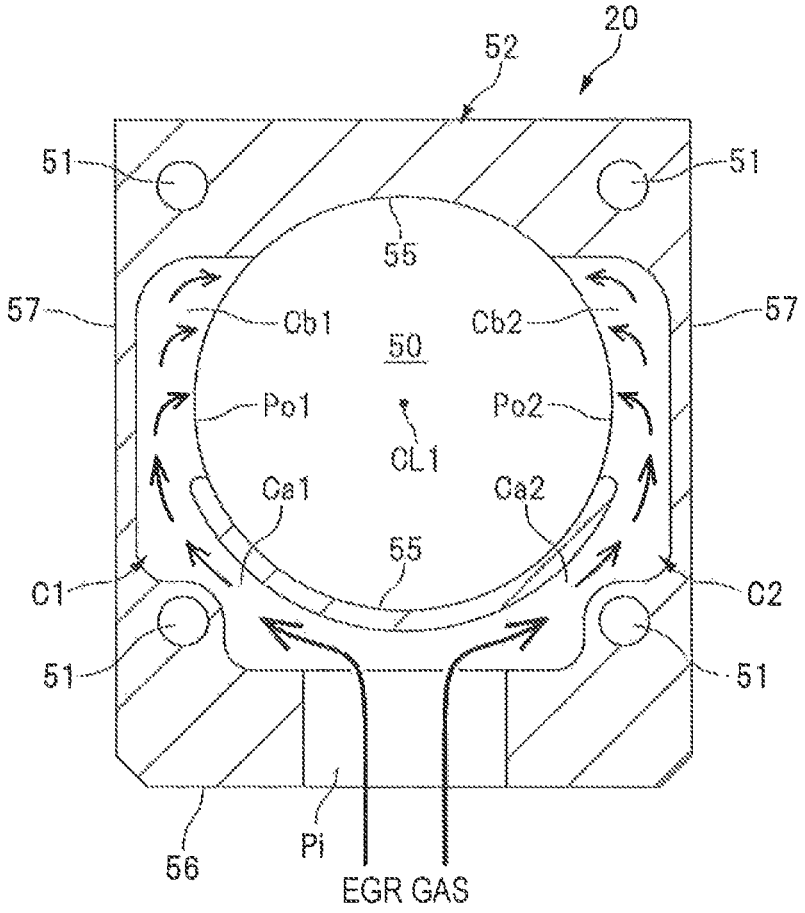
FIG. 9 is a sectional view of the EGR adapter, and illustrates a state of flow of EGR gas by using arrows.

Next, an opening area A1 of the discharge port Po1 that discharges EGR gas is described. FIG. 8 is an explanatory view illustrating an opening area A2 of the inlet port Pi and the opening area A1 of the discharge port Po1. FIG. 9 a sectional view of the EGR adapter 20, and illustrates a state of flow of EGR gas by using arrows. As illustrated by hatching in FIG. 8, the opening area A1 of the discharge port Po1 is larger than the opening area A2 of the inlet port Pi. Similarly, the opening area of the discharge port Po2 is larger than the opening area A2 of the inlet port Pi, By causing the opening area of the discharge port Po1 and the opening area of the discharge port. Po2 to be large in this way, as illustrated by arrows in FIG. 9, it is possible to disperse. EGR gas and reduce the flow rate, and to gently discharge the EGR gas from the discharge ports Po1 and Po2. That is, it is possible to supply the EGR gas to an intake air layer that flows near the channel wall 55, which is an inner peripheral surface defining the intake channel 50, that is, the intake air layer at which a large amount of turbulence is thought to occur, without breaking the intake air layer. Therefore, it is possible to actively mix the intake air and the EGR gas by making use of the turbulent flow of the intake air. Consequently, it is possible to reduce variations in the EGR percentage content in the intake air, and to substantially equally supply the EGR gas to each intake port 16.

Enlarged Structures of Coupling Channels

Figure 10:
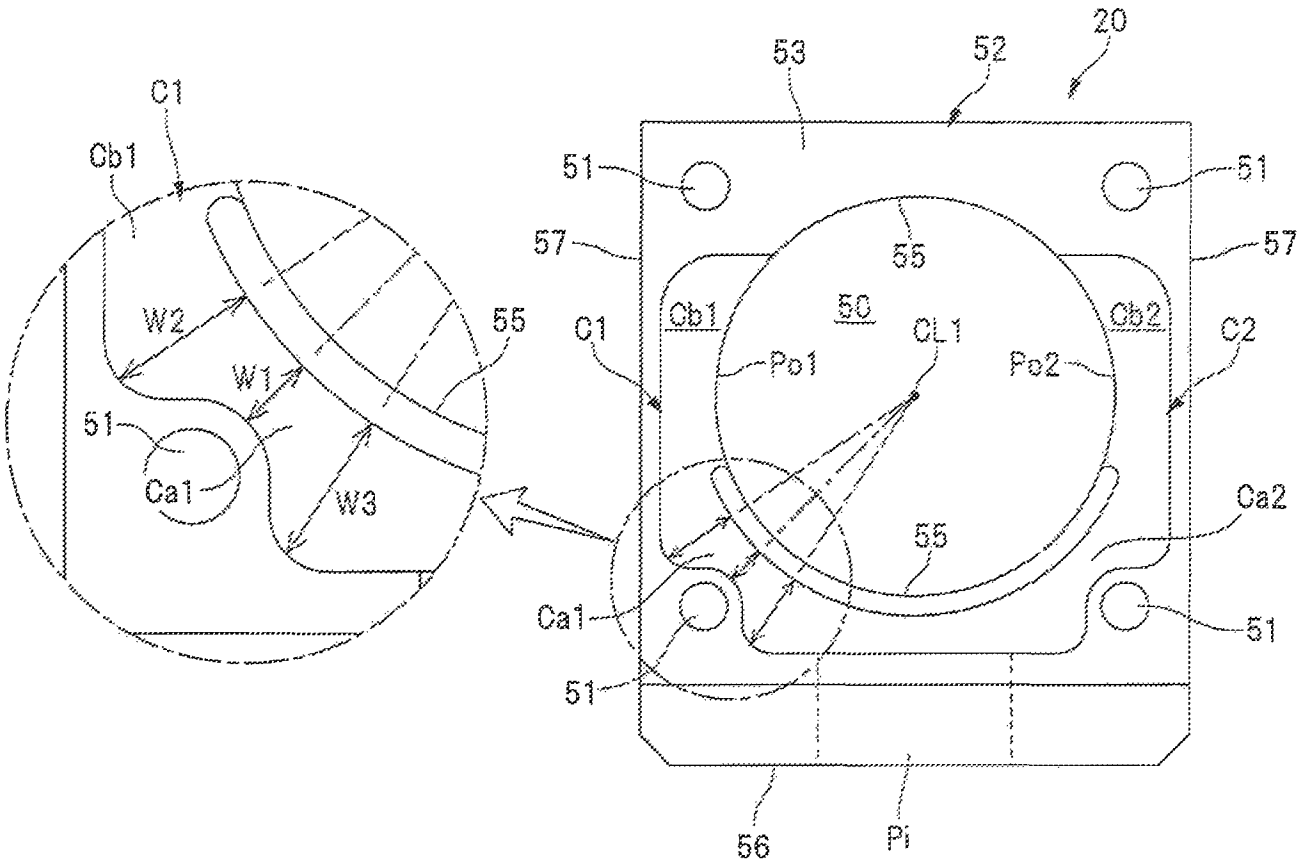
FIG. 10 is an explanatory view of structures of coupling channels of the EGR adapter.

Next, enlarged structures of the coupling channels C1 and C2 that guide EGR gas to the discharge ports Po1 and Po2 from the inlet port Pi are described. Here, FIG. 10 is an explanatory view of structures of the coupling channels C1 and C2 in the EGR adapter 20. As illustrated in FIG. 10, the adapter body 52 of the EGR adapter 20 includes a pair of coupling channels C1 and C2 from the lower portion 56 to the side portions 57. The inlet port Pi and the discharge port Po1 are coupled to each other via the coupling channel C1, and the inlet port Pi and the discharge port Po2 are coupled to each other via the coupling channel C2. The first coupling channel C1 includes the first expanded chamber Cb1 into which the discharge port Po1 opens. A boundary of the first expanded chamber Co1 is situated at the downstream side of the first restrictor Ca1, and the first expanded chamber Cb1 has a channel sectional area that is larger than that of the first restrictor Ca1. That is, as illustrated in FIG. 10, the first expanded chamber Cb1 has a channel width W2 that is larger than a channel width W1 of the first restrictor Ca1. Similarly, the second coupling channel C2 includes the second expanded chamber Cb2 at which the discharge port Po2 opens. A boundary of the second expanded chamber Cb2 is situated at the downstream side of the second restrictor Ca2, and the second expanded chamber Cb2 has a channel sectional area that is larger than that of the second restrictor Ca2.

By disposing the expanded chambers Cb1 and Cb2 in the respective coupling channels C1 and C2 in this way, as illustrated by the arrows in FIG. 9, it is possible to disperse EGR gas and reduce the flow rate, and, thus, to gently discharge the EGR gas from the discharge ports Po1 and Po2. That is, it is possible to supply the EGR gas to an intake air layer that flows near the channel wall 55, which is an inner peripheral surface defining the intake channel 50, that is, the intake air layer at which a large amount of turbulence is thought occur, without breaking the intake air layer. Therefore, it is possible to actively mix the intake air and the EGR gas by making use of the turbulent flow of the intake air. Consequently, it is possible to reduce variations in the EGR percentage content in the intake air, and to substantially equally supply the EGR gas to each intake port 16. In addition, by disposing the expanded chambers Cb1 and Cb2 in the respective coupling channels C1 and C2, it is possible to mix the EGR gas and the intake air in the expanded chambers Cb1 and Cb2. This makes it possible to accelerate the mixing of the intake air and the EGR gas, and to reduce variations in the EGR percentage content in the intake air.

Restricting Structures of Coupling Channels

Next, restricting structures of the coupling channels C1 and C2 that guide EGR gas to the discharge ports Po1 and Po2 from the inlet port Pi are described. As described above, the adapter body 52 of the EGR adapter 20 has the pair of coupling channels C1 and C2 from the lower portion 56 to the side portions 57. The inlet port Pi and the discharge port Po1 are coupled to each other via the coupling channel C1, and the inlet port Pi and the discharge port Po2 are coupled to each other via the coupling channel C2. The first coupling channel C1 includes the first restrictor Ca1 having a channel sectional area that is smaller than those of other portions of the coupling channel C1. That is, as illustrated in FIG. 10, the first restrictor Ca1 has the channel width W1 that is smaller than the channel width W2 at the downstream side thereof and the channel width W3 at the upstream side thereof. Similarly, the second coupling channel C2 includes the second restrictor Ca2 having a channel sectional area that is smaller than those of other portions of the coupling channel C2.

By disposing the restrictors Ca1 and Ca2 in the respective coupling channels C1 and C2 in this way, it is possible to reduce the flow rate of EGR gas that passes through the restrictors Ca1 and Ca2, so that it is possible to gently discharge the EGR gas from the discharge ports Po1 and Po2. In addition, by disposing the restrictors Ca1 and Ca2 in the respective coupling channels C1 and C2, it is possible to reduce pulsation of EGR gas that is introduced from the exhaust system, so that it is possible to gently discharge the EGR gas from the discharge ports Po1 and Po2. This makes it is possible to supply the EGR gas to en intake air layer that flows near the channel wall 55, which is an inner peripheral surface defining the intake channel 50, that is, the intake air layer at which a large amount of turbulence is thought to occur without breaking the intake air layer. Therefore, it is possible to actively mix the intake air and the EGR gas by making use of the turbulent flow of the intake air. Consequently, it is possible to reduce variations in the EGR percentage content in the intake air, and to substantially equally supply the EGR gas to each intake port 16.

Comparative Example

Figure 11:
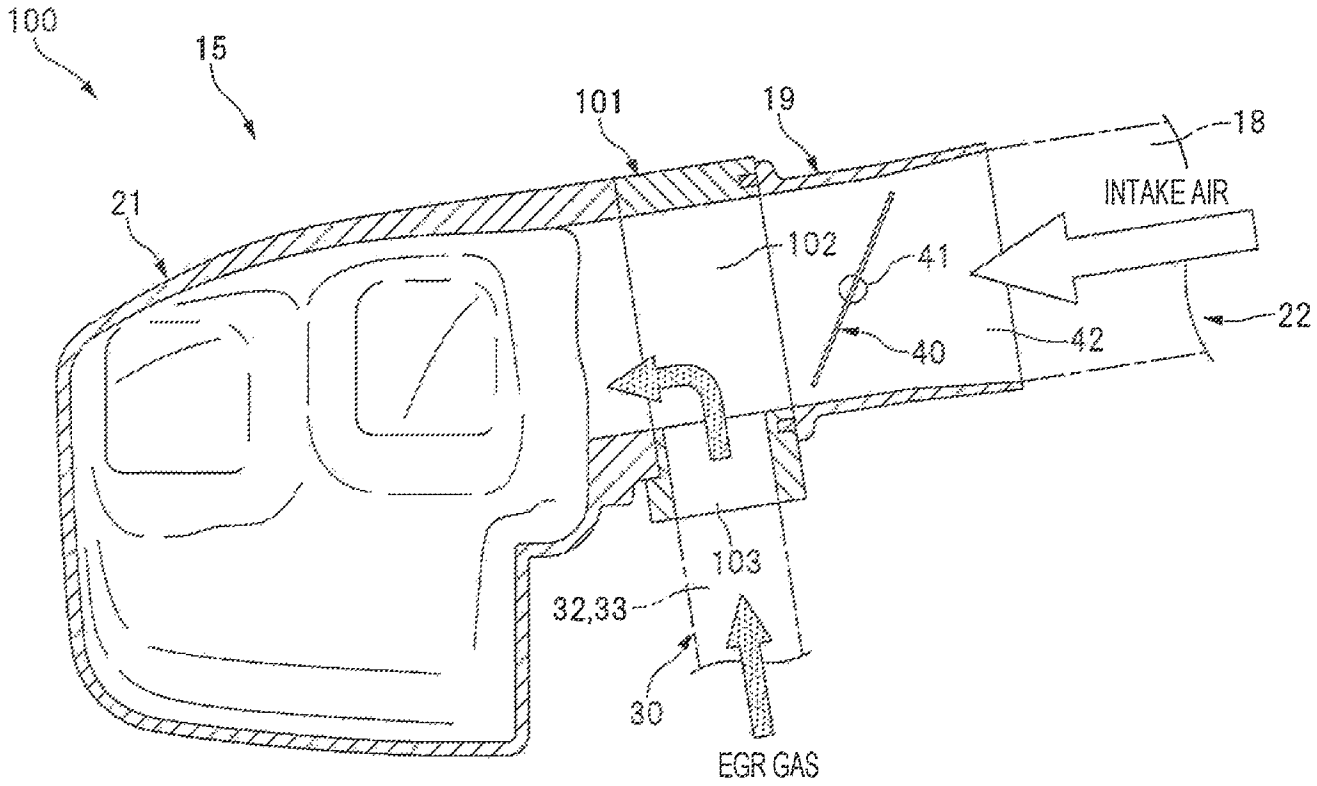
FIG. 11 is a sectional view of a exhaust gas recirculation apparatus according to a comparative example.
Figure 12:
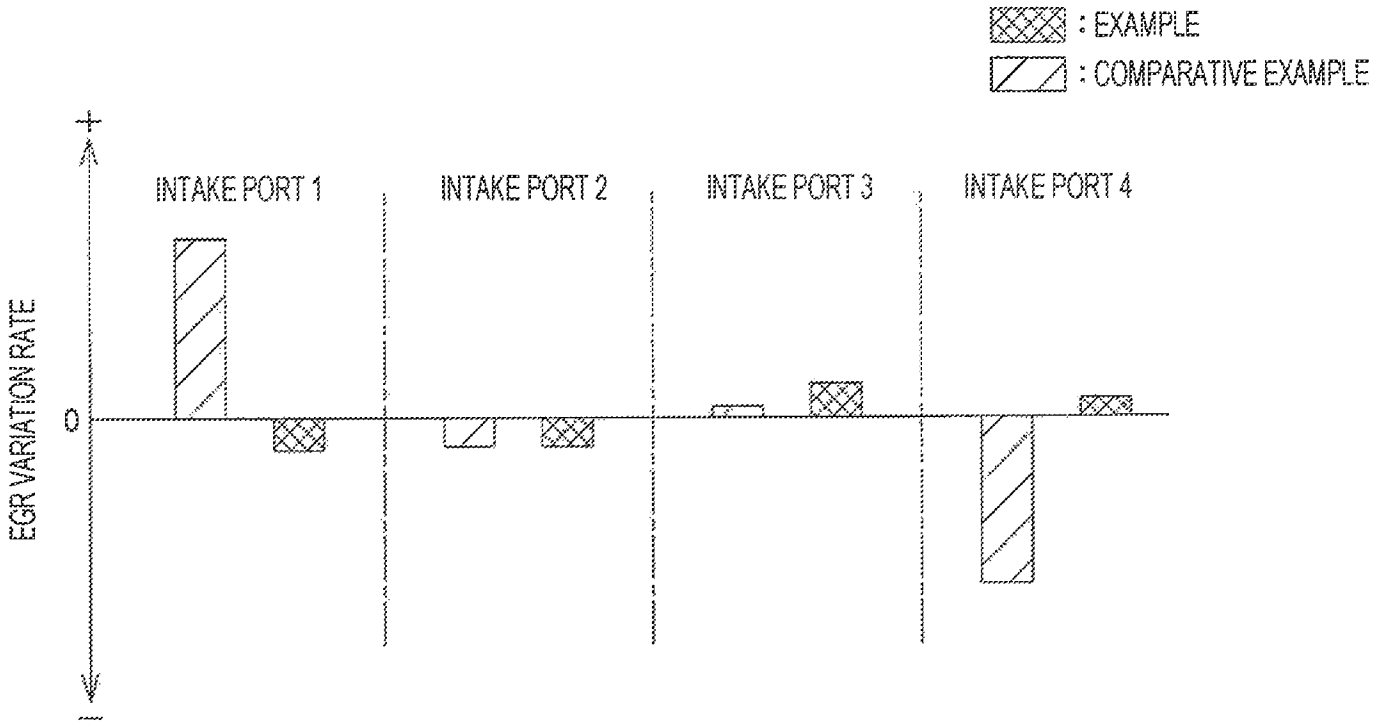
FIG. 12 is a comparative diagram illustrating a comparison between EGR variation rates according to the example and EGR variation rates according to the comparative example.

Next, a exhaust gas recirculation apparatus 100 is described as a comparative example, and the advantages of the exhaust gas recirculation apparatus 10 according to the example are described. Here, FIG. 11 is a sectional view of the exhaust gas recirculation apparatus 100 according to the comparative example. FIG. 12 is a comparative diagram illustrating a comparison between EGR variation rates according to the example and EGR variation rates according to the comparative example. The EGR variation rates in FIG. 12 are each the difference between the EGR percentage content of intake air as a whole and the EGR percentage content of intake air that is supplied to a corresponding one of the intake ports 16. That is, as the EGR variation rate approaches 0, the EGR percentage content of intake air that is supplied to each intake port 16 is equalized, and variations in the EGR percentage content are reduced.

As illustrated in FIG. 11, the exhaust gas recirculation apparatus 100 according to the comparative example includes an EGR adapter 101 between an intake manifold 21 and a throttle body 19. The EGR adapter 101 has an intake channel 102 that guides intake air, and an inlet port 103 to which an EGR supply path 33 is coupled. The inlet port 103 opens into the intake channel 102. EGR gas that has flown into the inlet port 103 is discharged directly to the intake channel 102. In this way, when the EGR gas is directly supplied to the intake channel 102 from the inlet port 103, it is difficult to uniformly mix the intake air and the EGR gas with each other. Therefore, as illustrated in FIG. 12, in the exhaust gas recirculation apparatus 100 according to the comparative example, large differences occur between the EGR variation rates of the corresponding intake ports 16. In contrast, in the exhaust gas recirculation apparatus 10 according to the example, as described above, since a lot of thought has been put in forming the discharge ports Po1 and Po2 and the coupling channels C1 and C2, it is possible to bring the EGR variation rates of the corresponding intake ports 16 close to each other.

The present invention is not limited to the above-described examples, and, thus, various changes may be made within a scope that does not depart from the gist of the present invention. Although, in the description above, the EGR adapter 20 has the pair of discharge ports Po1 and Po2, the EGR adapter 20 is not limited thereto. The EGR adapter 20 may have three or more discharge ports, or may have one discharge port. Although, in the description above, the side portions 57 of the EGR adapter 20 have the discharge ports Po1 and Po2, the EGR adapter 20 is not limited thereto. An upper portion and the lower portion 56 of the EGR adapter 20 may have the discharge ports Po1 and Po2. Although, in the description above, the lower portion 56 of the EGR adapter 20 has the inlet port Pi, the EGR adapter 20 is not limited thereto. Obviously, one of the side portions 57 or the upper portion of the EGR adapter 20 may have the inlet port Pi. Although, in the illustrated examples, the imaginary plane X coincides with the center line CL2 of the intake channel 50, the imaginary plane X is not limited thereto. The imaginary plane X may be parallel to the center line CL2 of the intake channel 50.

The invention claimed is:

1. An exhaust gas recirculation apparatus, comprising:

a throttle body that is configured to be disposed in an intake system of an engine, and comprises a throttle valve and a valve shaft that supports the throttle valve, the throttle valve comprising a first end and a second end;

an intake manifold that is configured to be disposed in the intake system of the engine, and distribute intake air to each intake port in the engine;

an adapter member that is configured to be disposed between the throttle body and the intake manifold, and that comprises a through channel capable of guiding the intake air to the intake manifold from the throttle body, the adapter member comprising an inlet port to which an exhaust gas supply path is coupled, a discharge port that is configured to discharge exhaust gas received at the inlet port into the through channel, and a coupling channel that couples the inlet port and the discharge port; and wherein the first end of the throttle valve is movable away from the adapter member when opening the throttle valve, and the second end of the throttle valve is movable towards the adapter member when opening the throttle valve, and wherein a first opening of the discharge port is wider than a second opening of the discharge port when the discharge port is divided into the first opening and the second opening at an imaginary plane, serving as a boundary, the first opening being disposed towards the first end, the second opening being disposed towards the second end, the imaginary plane including a center line of the valve shaft and extending along an extending-through direction of the through channel.

2. The exhaust gas recirculation apparatus according to claim 1, wherein an opening area of the discharge port is larger than an opening area of the inlet port.

3. The exhaust gas recirculation apparatus according to claim 1, wherein the adapter member further comprises a pair of the discharge ports opposing each other.

4. The exhaust gas recirculation apparatus according to claim 3, wherein the opposing discharge ports have the same configuration and each are configured to feed exhaust gas into the through channel.

5. The exhaust gas recirculation apparatus according to claim 1, wherein the imaginary plane is a plane that includes the center line of the valve shaft and that coincides with or is parallel to a center line of the through channel.

6. The exhaust gas recirculation apparatus according to claim 1, wherein the adapter member further comprises an expanded chamber that is disposed in the coupling channel and into which the discharge port opens.

7. The exhaust gas recirculation apparatus according to claim 6, wherein the adapter member further comprises a restrictor that is disposed in the coupling channel and upstream from the expanded chamber, and that has a channel sectional area that is smaller than those of other portions of the coupling channel.

8. The exhaust gas recirculation apparatus according to claim 1 wherein the discharge port is configured to provide initial exhaust contact with intake air passing through the through channel.

9. The exhaust gas recirculation apparatus according to claim 1 wherein, relative to intake air flow through the adapter member, the discharge port is configured to open into the through channel at a location between an upstream end and a downstream end of the adapter member.

10. The exhaust gas recirculation apparatus according to claim 1 further comprising an exhaust gas recirculation pipe that defines the exhaust gas supply path that is configured to feed exhaust gas to the inlet port and to the intake system.

11. The exhaust gas recirculation apparatus according to claim 1, wherein the coupling channel is partially defined by a channel wall that has a cylindrical curvature that extends over the inlet port.

12. The exhaust gas recirculation apparatus according to claim 11, wherein the channel wall has opposite free ends that define portions of commonly configured opposing discharge ports configured to feed exhaust gas into the through channel.

* * * * *